US005197364A

United States Patent [19]

Heutschi

[11] Patent Number: 5,197,364

[45] Date of Patent: Mar. 30, 1993

[54] METHOD OF AND APPARATUS FOR TRIMMING LATERAL MARGINAL PORTIONS OF SHEETS IN A STREAM OF PARTLY OVERLAPPING SHEETS

[75] Inventor: Kurt Heutschi, Wikon, Switzerland

[73] Assignee: GRAPHA-Holding AG, Hergiswil, Switzerland

[21] Appl. No.: 895,152

[22] Filed: Jun. 5, 1992

Related U.S. Application Data

[63] Continuation of Ser. No. 673,734, Mar. 22, 1991, abandoned.

[30] Foreign Application Priority Data

Apr. 2, 1990 [CH] Switzerland ..... 1093/90

[51] Int. Cl.[5] ..... B26D 7/06

[52] U.S. Cl. ..... 83/29; 83/13; 83/422; 83/425; 83/508; 83/934

[58] Field of Search ..... 83/13, 29, 409, 422, 83/425.2, 431, 435.1, 435.2, 508, 934, 425

[56] References Cited

U.S. PATENT DOCUMENTS

| | | | |
|---|---|---|---|
| 4,046,043 | 9/1977 | Kistner et al. | 83/934 |
| 4,075,917 | 2/1978 | Kistner et al. | 83/422 |
| 4,480,518 | 11/1984 | Futterer | 83/934 |
| 4,526,362 | 7/1985 | Thierstein | 271/186 |
| 4,566,360 | 1/1986 | Lehmann | 83/425.2 |

FOREIGN PATENT DOCUMENTS

| | | |
|---|---|---|
| 3221153 | 2/1983 | Fed. Rep. of Germany . |
| 650967 | 8/1985 | Switzerland . |

*Primary Examiner*—Hien H. Phan
*Attorney, Agent, or Firm*—Peter K. Kontler

[57] ABSTRACT

Apparatus for trimming lateral marginal portions of a scalloped stream of partially overlapping sheets has two counterknives at that side of the path for the sheets which is adjacent the leaders of successive sheets and a pair of rotary knives located opposite the counterknives at the side of the path which is adjacent the trailing ends of successive sheets. The sheets of the stream of sheets issuing from a printing machine must be inverted by 180° if the counterknives are located beneath the respective rotary knives. Trimming operations which are carried out upon successive sheets having leaders at that side of the path which is adjacent the counterknives are less likely to result in tearing of the sheets than the trimming operations in conventional apparatus. The blades of rotary knives are normally rotated to advance their cutting edges in the direction of transport of the scalloped stream while the cutting edges of the blades cooperate with the cutting edges of the respective counterknives to remove the surplus of sheet material at the lateral marginal portions of the moving sheets.

5 Claims, 2 Drawing Sheets

FIG. 1
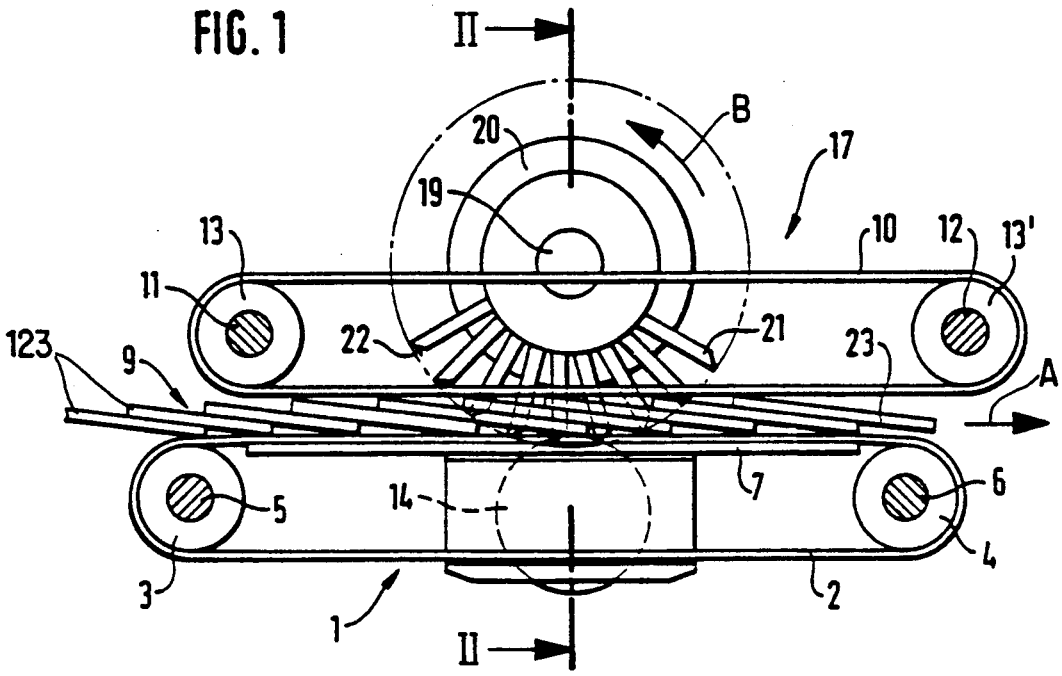
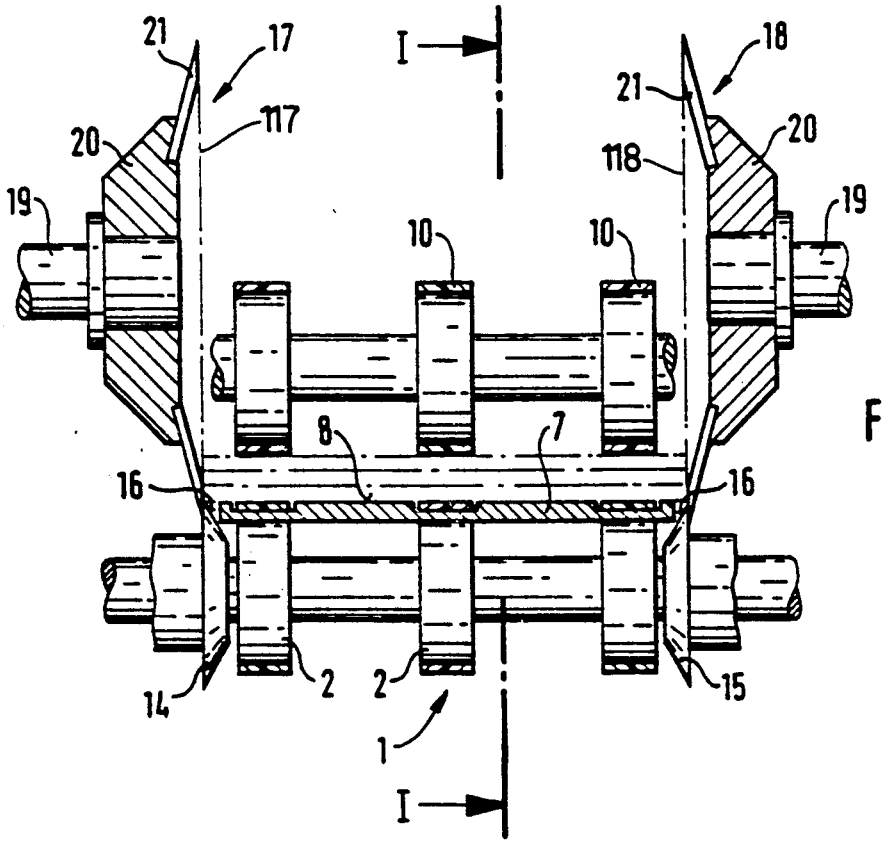
FIG. 2

METHOD OF AND APPARATUS FOR TRIMMING LATERAL MARGINAL PORTIONS OF SHEETS IN A STREAM OF PARTLY OVERLAPPING SHEETS

This application is a continuation of application Ser. No. 07/673,734, filed Mar. 22, 1991, now abandoned.

BACKGROUND OF THE INVENTION

The invention relates to improvements in apparatus for trimming, clipping or slitting lateral marginal portions of sheets which consist of paper or other flexible sheet material More particularly, the invention relates to improvements in trimming, clipping or slitting apparatus (hereinafter called trimming apparatus) which can be utilized with advantage to remove surplus material from lateral marginal portions of partially overlapping sheets which are transported in the form of a so-called scalloped or imbricated stream.

Swiss Pat. No. 650 967 discloses a trimming apparatus wherein conveyors are employed to transport a stream of partly overlapping sheets in a predetermined direction along an elongated path past two pairs of cooperating knives and counterknives, one pair at each side of the path. In order to ensure the making of clean cuts at the front and trailing ends as well as at other parts of successive sheets, irrespective of the thickness of individual sheets (the term "sheets" is intended to embrace individual sheets, sets of fully overlapping individual sheets, folded individual sheets and folded sets of two or more sheets), the cutting edges of blades forming part of rotary knives in the patented apparatus are oriented to make with the transporting plane for the sheets an angle of 0°-15°. In addition, when a blade is in a position of maximum overlap with the associated counterknife, it makes with the aforementioned plane an angle of 15° to 45°.

It has been found that, in actual practice, the above undertakings do not ensure the making of a clean cut all the way from the leader to the trailing end of each sheet. Thus, if the stream is assembled of partly overlapping groups of several sheets, e.g., signatures containing a relatively large number of printed pages, the blades of the knives which are located at a level above the stream are likely to tear the sheets substantially midway between the leaders and the trailing ends of the sheets. Attempts to avoid such tearing include changing the angle between the blades and the plane of the stream at the instant of maximum overlap of blades and the respective counterknives, changing the RPM of the knives and/or changing the shape of the counterknives. None of these undertakings can ensure reliable prevention of tearing of the sheets; this holds true for trimming apparatus of the type disclosed in the Swiss patent as well as for other types of trimming apparatus.

OBJECTS OF THE INVENTION

An object of the invention is to provide a trimming apparatus which is not only less likely but actually highly unlikely to tear the sheets of a scalloped stream of sheets even if the sheets are transported at an elevated speed and/or if each sheet comprises a plurality of overlapping panels.

Another object of the invention is to provide a novel and improved apparatus for trimming lateral marginal portions of a stream of partially overlapping pamphlets, brochures, newspaper sections, magazine sections and like components.

A further object of the invention is to provide an apparatus which can properly trim successive sheets of a scalloped stream of inverted or non-inverted sheets.

An additional object of the invention is to provide a trimming apparatus wherein the knife or knives and the counterknife or counterknives are mounted in a novel and improved way with reference to the path of movement of a scalloped stream of paper sheets or the like.

Still another object of the invention is to provide a novel and improved method of trimming brochures, pamphlets, newspaper sections, magazines or like products while the products are advanced at an elevated speed in partly overlapping relationship.

A further object of the invention is to provide an apparatus which can trim the lateral marginal portions of the above outlined products with a high degree of accuracy and smoothness, without tearing and at a high frequency.

Another object of the invention is to provide the apparatus with novel and improved means for maintaining successive products of the imbricated stream in optimum positions relative to the knife or knives and counterknife or counterknives.

A further object of the invention is to provide an apparatus which can satisfactorily trim the lateral marginal portions of successive products in an imbricated stream of products irrespective of whether the knife or knives are located at a level above or below the path for the products.

An additional object of the invention is to provide an apparatus which can properly trim successive products of an imbricated stream of products regardless of whether the counterknife or counterknives are located at a level above or below the path of the products.

SUMMARY OF THE INVENTION

The invention is embodied in an apparatus for trimming at least one lateral marginal portion of each of a series of successive sheets in a stream of partly overlapping sheets which have leaders and trailing ends. The apparatus comprises means for transporting the stream in a predetermined direction along an elongated path with the leaders of partly overlapping sheets located at one side and with the trailing ends of partly overlapping sheets located at the other side of the path opposite the one side, a counterknife at the one side of the path, and a rotary knife which is adjacent the other side of the path opposite the counterknife and defines with the counterknife a trimming or severing plane. The at least one lateral marginal portion of each sheet which is transported along the path toward and past the knife and the counterknife is located at one side and the remainder of each sheet is located at the other side of the severing plane so that the at least one marginal portion is separated from the remainder of the sheet.

The knife preferably comprises a rotary holder (e.g., a hub which is coaxially secured to a rotary drive shaft), and a plurality of blades which extend from the holder, e.g., substantially radially of the axis of rotation of the knife. The severing plane is defined by the counterknife in cooperation with the blades of the rotary knife.

If the one side of the predetermined path is located beneath the other side (i.e., if the counterknife is located at a level below the rotary knife), the transporting means is designed and is operative to maintain the sheets of the stream in such orientation that the trailing end of each sheet overlies the next-following sheet of the stream in the path.

On the other hand, if the one side of the predetermined path is located at a level above the other side (i.e., if the counterknife is mounted at a level above the knife), the transporting means is operative to maintain the sheets in such orientation that the leader of each sheet overlies the preceding sheet of the stream in the path. The transporting means of such apparatus can comprise an upper conveyor at the one side of the path and a lower conveyor at the other side of the path. The lower conveyor has a sheet-engaging portion which is movable toward and away from the upper conveyor, and the apparatus further comprises means for biasing the sheet-engaging portion of the lower conveyor toward the upper conveyor to bias the sheets of the stream in the path between the sheet-engaging portion of the lower conveyor and the upper conveyor. The lower conveyor can comprise at least one endless flexible belt having an upper reach which constitutes the sheet-engaging portion of the lower conveyor. The biasing means of such apparatus can comprise rollers which are adjacent and are located beneath the upper reach of the lower conveyor, and resilient means (e.g., discrete coil springs) for urging the rollers against the upper reach of the lower conveyor.

If the apparatus is designed to trim the at least one as well as the other lateral marginal portion of each of a series of successive sheets in a stream of partly overlapping sheets, such apparatus further comprises a second counterknife at the one side of the path and a second rotary knife which is located at the other side of the path opposite the second counterknife and defines with the second counterknife a second trimming or severing plane. The other lateral marginal portion each sheet which is transported along the predetermined path toward and past the second knife and the second counterknife is located at one side of the second severing plane and the remainder of each sheet is located at the other side of the second severing plane so that the other marginal portion is separated from the remainder of the sheet.

If the counterknife or counterknives are located at a level below the rotary knife or knives, the apparatus preferably further comprises means for inverting successive sheets of the stream upstream of the knife or knives and counterknife or counterknives.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a partly elevational and partly longitudinal vertical sectional view of an apparatus which embodies one form of the invention, the section being taken in the direction of arrows as seen from the line I—I in FIG. 2;

FIG. 2 is a transverse vertical sectional view substantially as seen in the direction of arrows from the line II—II in FIG. 1;

DESCRIPTION OF THE PREFERRED EMBODIMENTS

Figure 3:
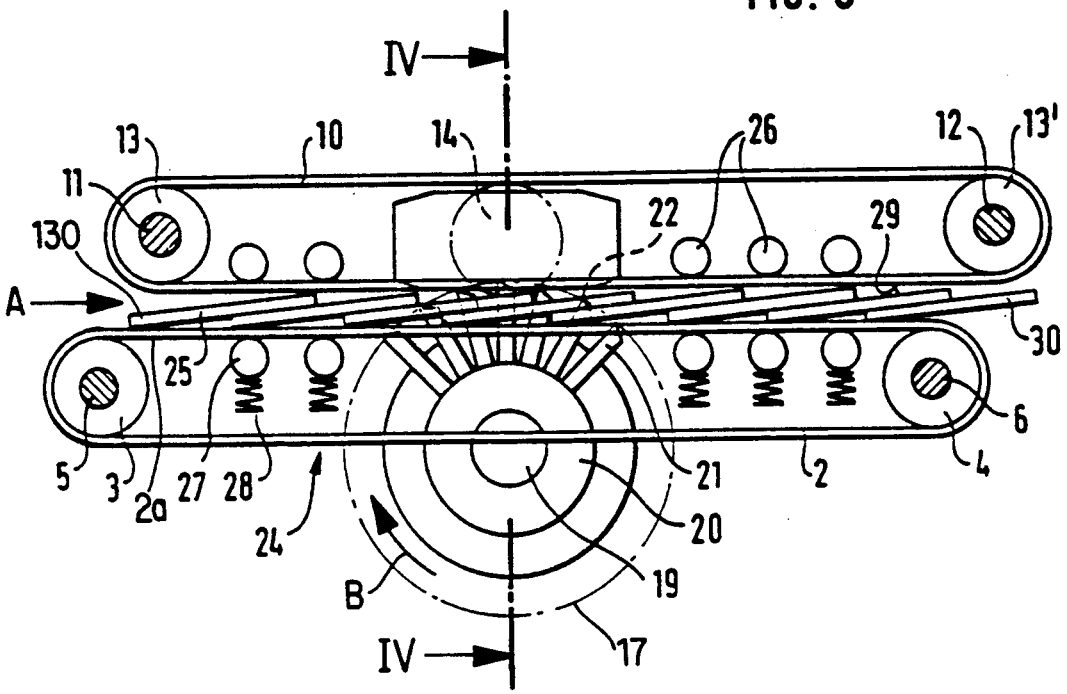
FIG. 3 is a partly elevational and partly longitudinal vertical sectional view of a second apparatus, the section being taken in the direction of arrows substantially as seen from the line III—III of FIG. 4.

The apparatus which is shown in FIGS. 1 and 2 resembles that which is shown in Swiss Pat. No. 650 967. It comprises means 1 for transporting a scalloped or imbricated stream of partly overlapping sheets 9 (e.g., folded paper sheets which bear printed matter and are shown only in FIG. 1) along an elongated substantially horizontal path in the direction of arrow A. The transporting means 1 comprises an upper conveyor composed of three endless belts 10 trained over pulleys 13, 13' which are respectively mounted on horizontal shafts 11 and 12. At least one of these shafts is driven to advance the lower reaches of the belts 10 in the direction of arrow A. The transporting means 1 further comprises a lower conveyor including three endless belts 2 which are trained over pulleys 3 and 4. These pulleys are mounted on shafts 5 and 6 at least one of which is driven to advance the upper reaches of the belts 2 in the direction of arrow A. The upper reaches of the belts 2 are recessed into shallow grooves which are provided in the upper side of a substantially horizontal platform 7 at the underside of the elongated path for the sheets 9. The underside of the path for the sheets 9 is located in a plane 8 which coincides with the plane of the upper side of the platform 7. The speed of the belts 2 matches that of the belts 10, and the distance of the lower reaches of the belts 10 from the plane 8 is selected in such a way that the trailing ends 123 of successive sheets 9 are pressed against the median portions of the immediately following sheets 9 with a force which suffices to prevent any shifting or any appreciable shifting of sheets relative to each other and relative to the adjacent reaches of the belts 2 and 10 during transport along their path toward and beyond the pulleys 6 and 13'. The leaders 23 of successive sheets 9 are adjacent the upper side of the platform 7, i.e., to the underside of the path for the stream of partially overlapping sheets 9.

The means for trimming the lateral marginal portions of successive sheets 9 during advancement with the adjacent reaches of the conveyor belts 2 and 10 comprises two counterknives 14, 15 which are located at the underside of the path for the sheets 9 and are disposed at opposite sides of the lower conveyor, i.e., outwardly adjacent the two outer endless belts 2. The trimming means further comprises two rotary knives 17 and 18 which are located at the upper side of the path for the sheets 9 and are respectively mounted opposite the counterknives 14 and 15. The counterknives 14 and 15 can rotate about a common horizontal axis which is parallel to the axes of the shafts 5, 6, 11 and 12 or about two parallel horizontal axes. The cutting edges 16 of the counterknives 14 and 15 are located in the plane 8, i.e., at the underside of the elongated path for the stream of sheets 9.

The knives 17, 18 are but need not be rotatable about a common axis and may but need not be driven at the same speed. FIGS. 1 and 2 show that the knives 17, 18 are mounted on discrete horizontal drive shafts 19 which are coaxial and whose axes are parallel to the axes of the shafts 5, 6, 11 and 12. Each of these knives comprises a centrally located holder or hub 20 which is affixed to the respective drive shaft 19, and a plurality of blades 21 which extend substantially radially outwardly relative to the respective hubs 20 and have cutting edges 22. These cutting edges cooperate with the cutting edges 16 of the respective counterknives 14, 15 to sever the adjacent portions of successive sheets 9 in two parallel vertical trimming or severing planes 117 and 118. The inclination of cutting edges 22 relative to the plane of the path for the sheets 9 (i.e., relative to the plane 8) is or can be the same as described hereinbefore with reference to the disclosure of Swiss Pat. No. 650,967.

When the improved trimming apparatus is in use, the shafts 11 and/or 12 and 5 and/or 6 are driven to advance the lower reaches of the belts 10 and the upper reaches of the belts 2 at the same speed in the direction of the arrow A. The belts 2 and 10 engage successive sheets 9 of the scalloped stream and advance the sheets in such a way that one lateral marginal portion of each sheet extends outwardly beyond the trimming plane 117 and the other lateral marginal portion of each sheet 9 extends outwardly beyond the trimming plane 118. The cutting edges 22 of the blades 21 of the knives 17, 18 (which are driven by the respective shafts to rotate in the direction of arrow B shown in FIG. 1) cooperate with the cutting edges 16 of the respective counterknives 14, 15 to separate the lateral marginal portions from the central portions of the sheets 9 in the corresponding trimming planes 117 and 118.

FIG. 1 shows that the orientation of sheets 9 in the scalloped stream is not a customary orientation, i.e., an orientation corresponding to that of sheets in a scalloped stream which issues from a printing machine. Instead, the leaders 23 of successive sheets 9 are located in the plane 8 at the underside of the path for the sheets between the belts 2 and 10 of the transporting means 1, and the trailing ends 123 of successive sheets 9 overlap the median portions of the immediately following sheets. In other words, if the orientation of sheets 9 in the illustrated scalloped stream were the same as that of sheets in the scalloped stream which issues from a printing machine, the leaders of successive sheets would be adjacent the upper side of their path between the belts 2 and 10. Such inversion of successive sheets 9 can be carried out in a number of ways, for example, in a manner as disclosed in commonly owned U.S. Pat. No. 4.526,632 to Thierstein. The disclosure of this patent is incorporated herein by reference. Another apparatus which can be used to invert successive sheets of a scalloped stream of sheets through an angle of 180° is disclosed in published German patent application No. 32 21 163. The inverting apparatus is located to the left of the apparatus of FIG. 1, i.e., upstream of the trimming station as seen in the direction of arrow A.

The motor or motors (not shown) which drive the knives 17 and 18 are preferably set to rotate the hubs 20 at a speed such that the peripheral speed of the knives 21 greatly exceeds the speed of movement of the belts 2 and 10. It has been found that, by the simple expedient of inverting successive sheets 9 of the scalloped stream ahead of the trimming station (so that the leaders 23 of successive sheets 9 are adjacent the plane 8 (i.e., adjacent that side of the path for the sheets 9 which is adjacent the counterknives 14 and 15, the lateral marginal portions of the sheets can be trimmed in a highly satisfactory way without tearing of the lateral marginal portions anywhere including midway or substantially midway between the leaders 23 and the trailing ends 123 of the respective sheets 9.

Figure 4:
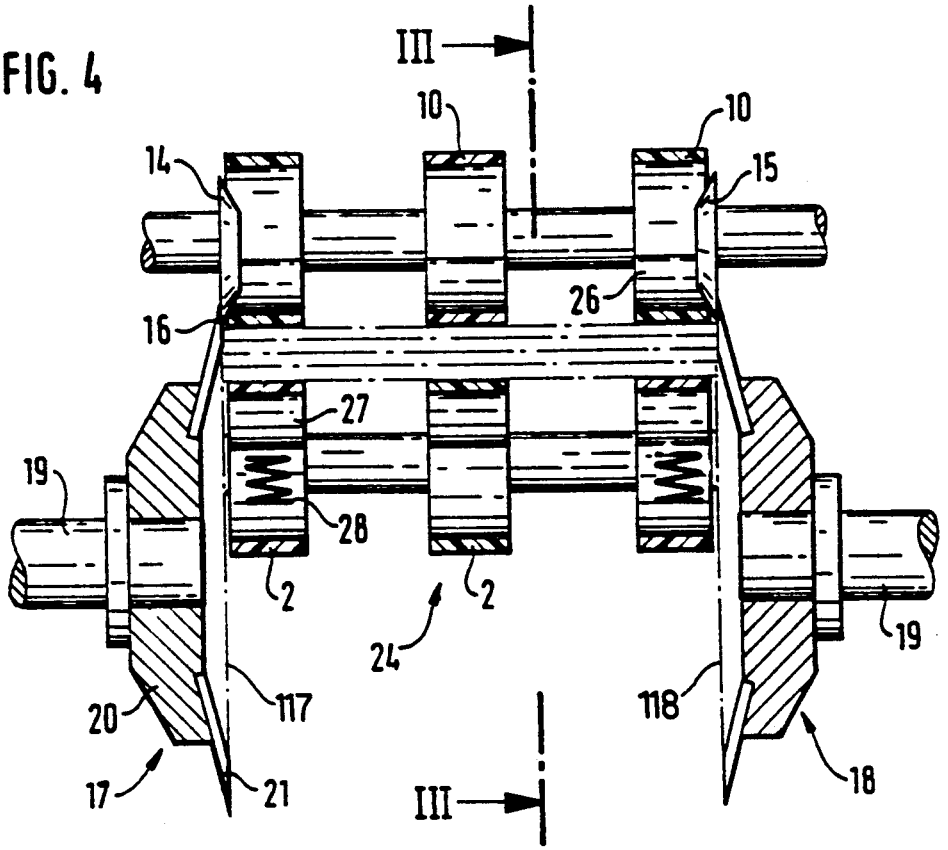
FIG. 4 is a transverse vertical sectional view substantially as seen in the direction of arrows from the line IV—IV of FIG. 3.

FIGS. 3 and 4 show a modified trimming apparatus which can be used to trim lateral marginal portions of successive sheets 25 without inversion of sheets ahead of the trimming station. The transporting means 24 of this apparatus comprises an upper conveyor composed of three endless belts 10 and a lower conveyor composed of three endless belts 2. The leaders 30 of successive sheets 25 are located at the upper side of the path for the scalloped stream of sheets 25 between the lower reaches of the belts 10 and the upper reaches **2*a* of the belts 2, and the counterknives 14, 15 are located above the respective rotary knives 17, 18. The belts 2 and 10 are driven at the same speed to advance the sheets 25** in the direction of arrow A.

The platform 7 of the apparatus which is shown in FIGS. 1 and 2 is omitted, and the apparatus of FIGS. 3–4 further comprises means for biasing the scalloped stream of sheets 25 against the lower reaches of the belts 10 in order to maintain the leaders 30 of the sheets at the upper side of the path, namely in the plane 29 of the cutting edges 16 of the counterknives 14 and 15. The biasing means comprises rollers 27 which are located below the upper reaches **2*a* of the belts 2 and are urged upwardly by resilient elements 28 in the form of stressed coil springs reacting against stationary parts of the frame (not shown in FIGS. 3 and 4). The lower reaches of the belts 10 are located immediately beneath fixedly mounted rollers 26 which prevent them from yielding to the bias of the stream of sheets 25. It can be said that the lower reaches of the belts 10 perform the function of the platform 7 in that they cooperate with the rollers 26 to maintain the leaders 30 of sheets 25 in the plane 29 at the upper side of the path for the scalloped stream of sheets 25. The trailing ends 130 of the sheets 25 are located in a plane at the underside of the path for the stream between the belts 2 and 10**.

The counterknives 14, 15 can be stationary or can be mounted for rotation about a common horizontal axis which is parallel to the axes of the shafts 5, 6, 11, 12 for the respective pulleys 3, 4, 13, 13'. As mentioned above, the cutting edges 16 of the counterknives 14 and 15 are located in the plane 29 which is defined by the lower reaches of the belts 10 in cooperation with the rollers 26.

The knives 17, 18 are rotatable beneath the respective counterknives 14, 15 and are constructed and mounted in the same way as described for the similarly referenced knives of the apparatus which is shown in FIGS. 1 and 2. The cutting edges 22 of the blades 21 cooperate with the cutting edges 16 of the respective counterknives to define two trimming or severing planes 117 and 118. The apparatus of FIGS. 3 and 4 separates from successive sheets 25 those lateral marginal portions of successive sheets 25 which extend outwardly beyond the respective trimming planes 117 and 118. The inverting apparatus is not needed because the counterknives 14, 15 are installed at a level above the knives 17, 18, i.e., the leaders 30 of the sheets 25 are disposed at that side of the path for the sheets which is nearer to the counterknives 14 and 15. The leader 30 of each preceding sheet 25 is located above a median portion of the immediately preceding sheet 25, and each following sheet overlies the trailing end 130 of the immediately preceding sheet. In other words, the orientation of sheets 25 is the same as is customary at the locus where printed sheets leave a printing machine.

The improved trimming apparatus is susceptible of many additional modifications without departing from the spirit of the invention. For example, the direction of rotation of the knives 17 and 18 can be reversed. This would necessitate reorientation of the cutting edges 22 on the blades 21. Since such reversal in the direction of rotation of knives 17 and 18 involves rotation counter to the direction (arrows A) of advancement of sheets 9 or 25, the speed of the knives 17, 18 is preferably further increased. The trimming apparatus which are shown in FIGS. 1-2 and 3-4 (wherein the direction of movement of blades 21 at the respective counterknives 14, 15 coincides with the direction of movement of the sheets 9 or 25) is preferred at this time because the trimming operation is more predictable.

The trimming apparatus of the present invention can be used to trim one lateral marginal portion of each of a series of successive partially overlapping sheets. For example, the sheets 9 or 25 can be advanced in such a way that one of their lateral marginal portions is located inwardly of the counterknife 14 or 15 and of the associated knife 17 or 18 so that only one lateral marginal portion of each sheet 9 or 25 is subjected to a trimming or slitting operation.

An important advantage of the improved trimming apparatus is that tearing of sheets 9 or 25 is avoided by the simple expedient of advancing the stream of partly overlapping sheets in such a way that the leaders 23 or 30 of the sheets are located at that side of the path for the sheets which is adjacent the counterknives 14 and 15. If the knives 17, 18 are to be mounted at a level above the path for the sheets 9, the sheets must be inverted by 180° so that their leaders 23 are located at the underside of the normally horizontal or nearly horizontal path for the scalloped stream of sheets. If the inverting step is to be dispensed with, the positions of the knives 17, 18 and of the associated counterknives 14, 15 are interchanged, i.e., the knives 17 and 18 are mounted at a level beneath the associated counterknives 14 and 15.

Another important advantage of the improved trimming apparatus is that it can employ all or nearly all components of a conventional trimming apparatus. This includes the construction of the transporting means 1 or 24, the counterknives 14, 15 and the rotary knives 17 and 18. Still further, the trimming apparatus of FIGS. 1 and 2 can be used in combination with any suitable conventional sheet- or stream-inerting apparatus such as that disclosed in the aforementioned U.S. Pat. No. 4,526,362 to Thierstein or that disclosed in the aforementioned published German patent application No. 32 21 153.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of trimming at least one lateral marginal portion of each of a series of successive sheets in a stream of partly overlapping sheets which have leaders and trailing ends, comprising the steps of transporting the stream in a predetermined direction along an elongated path with the leaders of partly overlapping sheets located at one side and with the trailing ends of partly overlapping sheets located at the other side of the path opposite the one side; positioning a counterknife at the one side of the path; and positioning a rotary holder with a plurality of knife blades extending from the rotary holder at the other side of the path opposite the counterknife so that the blades and the counterknife define a severing plane, said transporting step including advancing the at least one marginal portion of each sheet at one side and advancing the remainder of each sheet at the other side of the severing plane so that the at least one marginal portion is separated from the remainder of the sheet.

2. The method of claim 1, further comprising the step of locating said one side of said path beneath said other side, said transporting step comprising maintaining the sheets in such orientation that the trailing end of each sheet overlies the next-following sheet of the stream in said path.

3. The method of claim 1, further comprising the step of locating said one side of said path above said other side, said transporting step comprising maintaining the sheets in such orientation that the leader of each sheet overlies the preceding sheet of the stream in said path.

4. The method of claim 1, further comprising the step of inverting successive sheets of the stream upstream of the knife and the counterknife.

5. The method of claim 1 of trimming the at least one and a second lateral marginal portion of each of a series of successive sheets in said stream of partly overlapping sheets which have leaders and trailing ends, further comprising the steps of positioning a second counterknife at one side of the path, positioning a second rotary holder with a plurality of second knife blades extending from the second rotary holder at the other side of the path opposite the second counterknife so that the second knife blades and the second counterknife define a second severing plane, said transporting step further including advancing the second marginal portion at one side of said second severing plane and advancing the remainder of each sheet at the other side of said second severing plane so that the second marginal portion is separated from the remainder of the sheet.

* * * * *